US010245831B2

(12) United States Patent
Otaka et al.

(10) Patent No.: US 10,245,831 B2
(45) Date of Patent: Apr. 2, 2019

(54) LIQUID DISCHARGE HEAD, LIQUID DISCHARGE DEVICE, AND METHOD FOR MANUFACTURING LIQUID DISCHARGE HEAD

(71) Applicant: CANON KABUSHIKI KAISHA, Tokyo (JP)

(72) Inventors: Shimpei Otaka, Kawasaki (JP); Akira Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/495,809

(22) Filed: Apr. 24, 2017

(65) Prior Publication Data

US 2017/0326876 A1 Nov. 16, 2017

(30) Foreign Application Priority Data

May 16, 2016 (JP) ..... 2016-098242

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/164* (2013.01); *B41J 2002/14491* (2013.01)

(58) Field of Classification Search
CPC ..... B41J 2/1433; B41J 2/162; B41J 2/164
See application file for complete search history.

(56) References Cited

U.S. PATENT DOCUMENTS

2011/0279550 A1* 11/2011 Otaka ..... B41J 2/155 347/54
2012/0007926 A1* 1/2012 Kawamura ..... B41J 2/14016 347/71
2015/0109369 A1* 4/2015 Nagata ..... B41J 2/14024 347/54

FOREIGN PATENT DOCUMENTS

JP 2011-240549 A 12/2011

* cited by examiner

*Primary Examiner* — Jason S Uhlenhake
(74) *Attorney, Agent, or Firm* — Canon U.S.A., Inc. I.P. Division

(57) ABSTRACT

At least one embodiment of a liquid discharge head includes a liquid discharge substrate, a support substrate on which a back surface of the liquid discharge substrate is joined, and a wiring substrate. A second edge of the liquid discharge substrate and at least one third edge that forms a surface of the support substrate and is in contact with the back surface of the liquid discharge substrate, intersect at an intersecting point. A sealing agent for sealing an electric connection portion between the liquid discharge substrate and the wiring substrate extends over a portion of the second edge extending toward at least one second side surface of the liquid discharge substrate from a space on a lower side of the electric connection portion, to reach at least the intersecting point.

20 Claims, 6 Drawing Sheets

LIQUID DISCHARGE HEAD, LIQUID DISCHARGE DEVICE, AND METHOD FOR MANUFACTURING LIQUID DISCHARGE HEAD

BACKGROUND OF THE INVENTION

Field of the Invention

The present disclosure relates to a liquid discharge head that discharges liquid, a liquid discharge device on which the liquid discharge head is mounted, and a method for manufacturing the liquid discharge head.

Description of the Related Art

A liquid discharge substrate includes a silicon base and has an element substrate and a discharge port member for discharging liquid. The element substrate includes a pressure generation element that generates pressure for discharging the liquid such as ink. The member is provided on a surface side of the element substrate. The liquid discharge head includes the liquid discharge substrate, a wiring substrate including wiring that is electrically connected to the liquid discharge substrate, and a support substrate on which the liquid discharge substrate is joined. The wiring substrate is a member for supplying power to the liquid discharge substrate and the liquid discharge device main body, and is electrically connected to the liquid discharge substrate and the liquid discharge device main body.

Generally, the liquid discharge substrate and the wiring substrate are electrically connected to each other through wire joining or with a flying lead. After the electrical connection has been established, a liquid sealing agent is applied to an electric connection portion between the liquid discharge substrate and the wiring substrate, which includes a wire and lead, and then is cured. Thus, the electric connection portion is sealed with the sealing agent electrically insulated and protected from liquid. The liquid sealing agent used in this case includes an epoxy resin or acrylic resin composition of thermosetting, ultra violet (UV) curing, or moisture curing type.

In a case of one known method for protecting the electric connection portion with the sealing agent, a sealing agent with a low viscosity and a sealing agent with a high viscosity are respectively applied to an upper and lower side of the wire or the lead, and both agents are cured. With the sealing agents of two kinds of viscosities, the sealing agent can be evenly applied to the lower side of the wire or the flying lead.

However, if the sealing agent with a low viscosity is applied to the lower side of the electric connection portion, the agent may spread beyond the lower side of the electric connection portion. If the sealing agent of low viscosity spreads beyond the electric connection portion, an amount of the sealing agent sufficient for protection of the electric connection portion does not stay at the lower side of the electric connection portion. Thus, the electric connection portion cannot be effectively protected.

Japanese Patent Application Laid-Open No. 2011-240549 discusses a configuration for addressing this problem. More specifically, the liquid discharge substrate is disposed in an inner side of a device hole formed on the wiring substrate. A sealing agent is applied to a groove defined by the liquid discharge substrate, the support substrate, and the device hole. Thus, the agent sealing the electric connection portion is stemmed in the device hole, and thus can be applied to the lower side of the electric connection portion without spreading beyond the electric connection portion.

However, the wiring substrate provided with the device hole surrounding the liquid discharge substrate becomes larger than that without the device hole, and thus a size of the liquid discharge head also becomes larger. This issue arises in the liquid discharge head, such as a line head, with a plurality of liquid discharge substrates arranged in an arrayed direction of discharge ports. More specifically, if each liquid discharge substrate is surrounded by a device hole, the wire substrate and the liquid discharge head become all the more large.

On the other hand, without walls for enclosing the sealing agent provided around the liquid discharge substrate, the sealing agent flows beyond the electric connection portion and thus fails to stay at a desired position. Thus, the electric connection portion is difficult to effectively protect. Especially, a sealing agent with a low viscosity is likely to spread outside the desired portion.

SUMMARY OF THE INVENTION

The present disclosure is directed to at least one configuration in which an electric connection portion is surely sealed with a sealing agent, while preventing an increase of a liquid discharge head size and preventing the sealing agent from spreading outside the electric connection portion.

According to an aspect the present disclosure, at least one embodiment of a liquid discharge head includes a surface on which a pad is disposed close to a first edge, a first side surface that is adjacent to the surface with the first edge in between, a second side surface that is adjacent to the surface and the first side surface, and a back surface that is adjacent to the first side surface with a second edge in between, the second edge being opposite to the first edge. Further, the liquid discharge head includes a liquid discharge substrate configured to discharge liquid, a wiring substrate including wiring, a support substrate that is in contact with the second edge and includes a surface on which the back surface of the liquid discharge substrate is joined, and a sealing agent provided in a space defined by the surface of the support substrate, the first side surface, and an electric connection portion in which the pad and the wiring are electrically connected to each other, the electric connection portion extending in a direction crossing the first edge as viewed from the surface of the liquid discharge substrate. In an embodiment, the second edge and a third edge intersect at an intersecting point, the third edge forming the surface of the support substrate and contacting the back surface of the liquid discharge substrate. In at least one embodiment, the sealing agent extends over a portion of the second edge extending toward the second side surface from the space, to reach at least the intersecting point.

According to other aspects of the present disclosure, one or more additional liquid discharge heads, one or more liquid discharge devices and one or more methods of manufacturing liquid discharge heads are discussed herein. Further features of the present disclosure will become apparent from the following description of exemplary embodiments with reference to the attached drawings.

DESCRIPTION OF THE EMBODIMENTS

At least one exemplary embodiment of the present disclosure is described below with reference to the drawings.

Figure 1A:
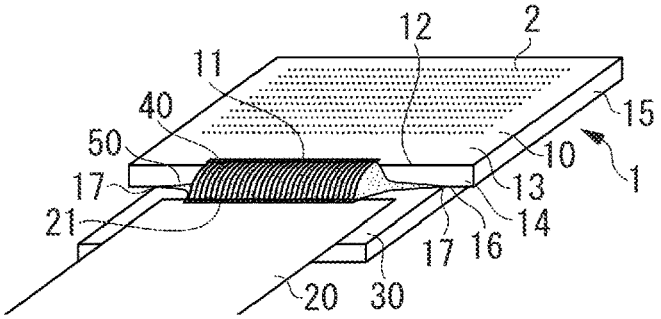
FIGS. 1A to 1D are each a diagram illustrating a liquid discharge head to which a first sealing agent is applied.
Figure 1B:
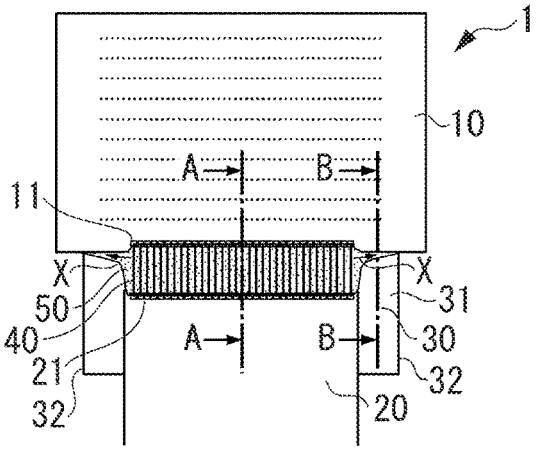
Figure 1C:
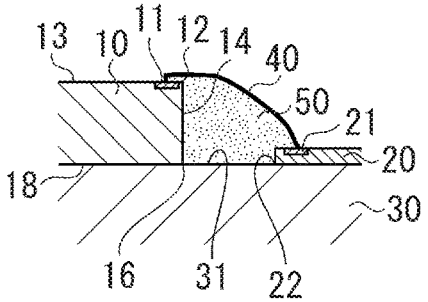
Figure 1D:
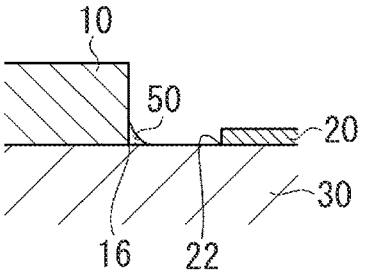
Figure 2:
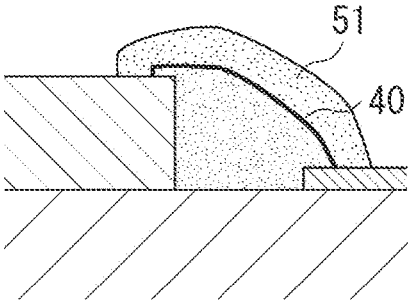
FIG. 2 is a cross-sectional view of the liquid discharge head to which a second sealing agent is applied.
Figure 3A:
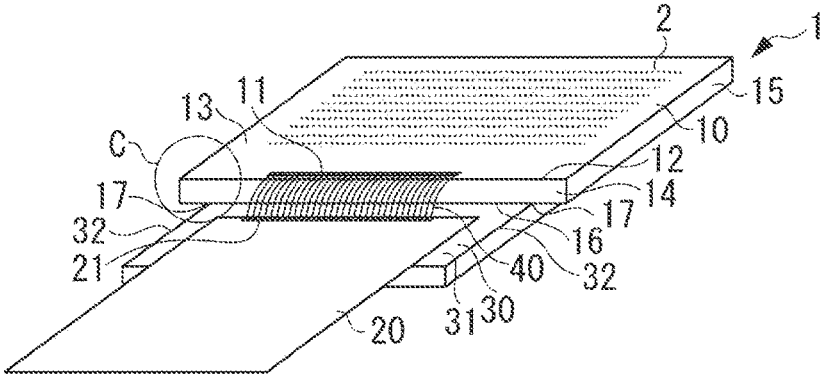
FIGS. 3A to 3D are each a diagram illustrating the liquid discharge head before the sealing agent is applied.
Figure 3B:
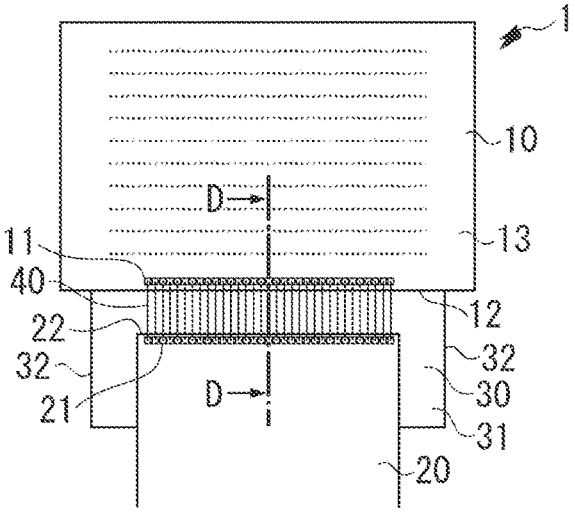
Figure 3C:
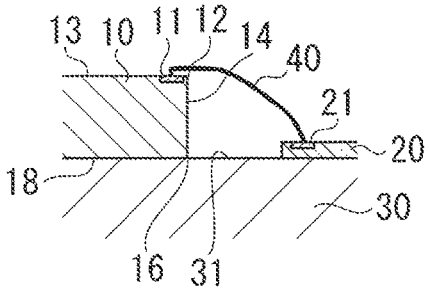
Figure 3D:
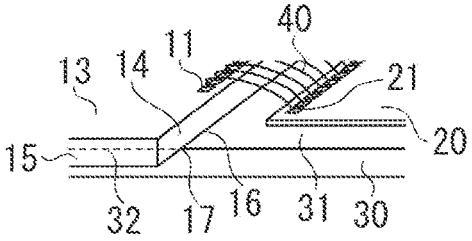

FIG. 1A is a perspective view of a liquid discharge head. FIG. 1B is an upper view of the liquid discharge head. FIG. 1C is a cross-sectional view taken along line A-A in FIG. 1B. FIG. 1D is a cross-sectional view taken along line B-B in FIG. 1B. FIGS. 1A to 1D each illustrate the liquid discharge head when a first sealing agent described below is applied, but a second sealing agent described below is not yet applied. FIG. 2 is a cross-sectional view of the liquid discharge head when the first sealing agent and the second sealing agent are applied. FIG. 3A is a perspective view of the liquid discharge head before the first sealing agent and the second sealing agent are applied, and FIG. 3B is an upper view of the liquid discharge head in the same state. FIG. 3C is a cross-sectional view taken along line D-D in FIG. 3B. FIG. 3D is an enlarged view of a section C in FIG. 3A.

A liquid discharge head 1 includes discharge ports 2 through which liquid such as ink is discharged, a liquid discharge substrate 10 including a silicon base, a wiring substrate 20 including electrical wiring, and a support substrate 30 to which the liquid discharge substrate 10 and the wiring substrate 20 are joined by an adhesive. A pad 11 disposed on the liquid discharge substrate 10 and a pad 21 disposed on the wiring substrate 20 are electrically connected to each other through a wire 40. Alumina, for example, is used as a material of the support substrate 30.

As illustrated in FIG. 3A, when the pad 11 is connected with the pad 21, the wire 40 is in contact with no portion other than the pad 11 and the pad 21. The wire 40 stays in this state because, if the wire 40 connects the other portions, electricity, short circuiting, or damage on the wire 40 may occur.

In this specification, a portion where the liquid discharge substrate 10 and the wiring substrate 20 are in contact with each other is referred to as an electric connection portion. In the present exemplary embodiment, the pad 11 on the liquid discharge substrate 10, the pad 21 on the wiring substrate 20, and the wires 40 connecting these are collectively referred to as the electric connection portion. The electric connection between the liquid discharge substrate 10 and the wiring substrate 20 is performed not only by the wire joining, but also by a flying lead.

The wiring substrate 20 establishes an electrical connection between the liquid discharge substrate 10 and a liquid discharge device main body on which the liquid discharge head 1 is mounted. More specifically, the electrical connection between the wiring substrate 20 and the liquid discharge device main body is established via a contact pin, a connector, or the like. The support substrate 30 is provided with a supplying port (not illustrated) which is communicated with the liquid discharge substrate 10. Liquid is supplied from the liquid discharge device main body to the liquid discharge substrate 10 through the supplying port.

As illustrated in FIG. 3A, the liquid discharge substrate 10 has a surface 13 on which the pad 11 is disposed close to a first edge 12. A plurality of the pads is arranged along the first edge 12, and thus a plurality of the pads 21 and the wires 40 are also disposed on a surface of the wiring substrate 20. The liquid discharge substrate 10 includes a first side surface 14 adjacent to the surface 13 with the first edge 12 in between, and two second side surfaces 15 (FIG. 3A and FIG. 3D) that are adjacent to the surface 13 and the first side surface 14 and are opposing each other. Further, the liquid discharge substrate 10 includes a back surface 18 (FIG. 3C) that is adjacent to the first side surface 14 with a second edge 16 opposing the first edge 12, in between. In the liquid discharge substrate 10 according to the present exemplary embodiment, end portions in an arrayed direction of the discharge ports 2 include the second side surfaces 15, and end portions in a direction orthogonal to the arraying direction of the discharge ports 2 include the first side surfaces 14.

The wires 40 are disposed to cross the first edge 12, and extend between the pads 11 of the liquid discharge substrate 10 and the pads 21 of the wiring substrate 20, as viewed from the surface 13 of the liquid discharge substrate 10. The wiring substrate 20 is provided with no device hole surrounding the liquid discharge substrate 10, and is disposed to face the first side surface 14 of the liquid discharge substrate 10 and is not disposed to facie the second side surfaces 15.

As illustrated in FIG. 3C, the back surface 18 as an opposite surface of the surface 13 of the liquid discharge substrate 10, and the back surface of the wiring substrate 20 are joined to the surface 31 of the support substrate 30. A distance between the surface 31 of the support substrate 30 and the pad 21 of the wiring substrate 20 in an orthogonal direction orthogonal to the surface 31 of the support substrate 30, is shorter than a distance between the surface 31 of the support substrate 30 and the pad 11 of the liquid discharge substrate 10 in the orthogonal direction.

As illustrated in FIG. 3D, the end portion of the liquid discharge substrate 10 on the side of the first side surface 14 does not retract from the end portion of the surface 31 of the support substrate 30 as viewed from the surface 13 of the liquid discharge substrate 10, whereas the end portions of the liquid discharge substrate 10 on the sides of the second side surfaces 15 protrude beyond the end portions of the surface 31 of the support substrate 30 as viewed from the surface 13 of the liquid discharge substrate 10. More specifically, as illustrated in FIG. 3A, the second edge 16 forming the back surface 18 of the liquid discharge substrate 10 is contacting the surface 31 of the support substrate 30 and the edges 32 forming the surface 31 of the support substrate 30 are contacting the back surface 18 of the liquid discharge substrate 10. As illustrated in FIG. 3D, the second edge 16 and the third edges 32 intersect each other at intersecting points 17.

Next, how the electric connection portion is sealed is described. The electric connection portion in contact with liquid may short out when it contacts liquid. Therefore, the connection portion is covered with a sealing agent to be in an insulated state for protection. As illustrated in FIG. 1C, which is a cross-sectional view taken along line A-A in FIG. 1B, a first sealing agent 50 is applied to a space on a lower side of the wires 40, and thus the lower side of the wires 40 is in the insulated state for protection. The space on the lower side of the wires 40 is defined by the wires 40, the first side surface 14 of the liquid discharge substrate 10, and the surface 31 of the support substrate 30.

It is desirable that the first sealing agent 50 is a curable liquid resin such as epoxy resin, acrylic resin, epoxy acrylate resin, imide resin, and amide resin. The resin can be cured by a wide variety of methods including cure by mixing with a curing agent, thermal cure with heat, and ultraviolet (UV)

cure with ultraviolet radiation. Among these, thermosetting epoxy resin is generally used as the first sealing agent 50.

Next, a method for applying the first sealing agent 50 is described. First of all, the first sealing agent 50 is applied from the upper side of the wires 40. For example, when the wires 40 having a wire diameter of 30 μm are arranged with a pitch of 100 μm, a gap of 70 μm is formed between adjacent wires 40. The first sealing agent 50 applied from above the wires 40 flows to the lower side of the wires 40 through the gaps between the adjacent wires 40, so that the first sealing agent 50 is applied on the lower side of the wires 40.

It is desirable that a curable and low viscosity sealing agent is used as the first sealing agent 50 to be applied to the lower side of the wires 40 through gaps between the wires 40 so that sufficient coating is carried out in the space on the lower side of the wires 40. This is because, if the first sealing agent 50 has a high viscosity, it may stay on the upper side of the wires 40, and may not be effectively applied on the lower side of the wires 40. The viscosity of the first sealing agent 50 is preferably in a range between 0.1 to 100 Pas and is more preferably in a range between 1 to 80 Pa·s.

The first sealing agent 50 applied to the space on the lower side of the wires 40 has a low viscosity, so that it is likely to spread out from the space on the lower side of the wires 40. More specifically, as illustrated in FIG. 1B, due to a capillary phenomenon, the sealing agent may spread over the second edge 16 of the liquid discharge substrate 10 contacting the surface 31 of the support substrate 30, in a direction toward the second side surfaces 15, that is, in directions indicated by arrows X. As a result, the first sealing agent 50 is applied to a portion outside the space on the lower side of the wires 40 as illustrated in FIG. 1D, which is a cross-sectional view taken along line B-B in FIG. 1B.

Although an edge 22 (FIG. 3B) of the wiring substrate 20 which contacts the surface 31 of the support substrate 30, is close to the area where the first sealing agent 50 is applied, the first sealing agent 50 is more likely to spread over the second edge 16. This is because tape automated joining (TAB) or a flexible printed circuit (FPC) having a surface covered with amide resin or imide resin is used in the wiring substrate 20, and the first sealing agent 50 has a lower wettability in reaction to these types of resin, compared with the liquid discharge substrate 10 including the silicon base.

The first sealing agent 50 spreading over and along the second edge 16 reaches the intersecting points 17 (FIG. 3D) of the second edge 16 and the third edges 32 forming the surface 31 of the support substrate 30. The capillary phenomenon will cause the first sealing agent 50 to further spread the first sealing agent 50 onto the third edges 32 contacting the back surface 18 of the liquid discharge substrate 10. Still, the second edge 16 and the third edges 32 extend in directions orthogonal to each other, whereby counterforce acts against the spreading of the first sealing agent 50 along the second edge 16 due to the capillary phenomenon described above. Thus, the first sealing agent 50 that has reached the intersecting points is prevented from further spreading near the intersecting points 17 owing to surface tension of the first sealing agent 50, and thus stays at a portion around the intersecting points 17.

Figure 4A:
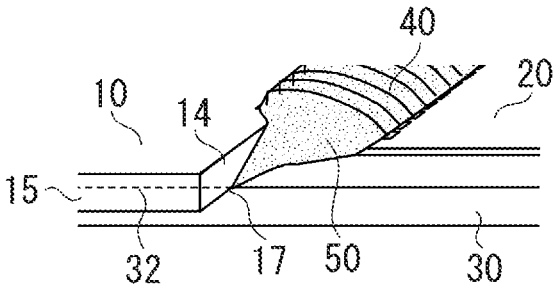
FIGS. 4A and 4B are each a diagram illustrating a state where the first sealing agent has stopped spreading.

Accordingly, the first sealing agent 50 stays at the intersecting points 17 as illustrated in FIG. 4A. Thus, the first sealing agent 50 can protect the lower side of the wires 40, while being prevented from spreading. Thus, the first sealing agent 50 flows from the space over the lower side of the wires 40 to the intersecting points 17, while it extends over a portion of the second edge 16 contacting the support substrate 30, toward the second side surfaces 15 of the liquid discharge substrate 10.

In the present exemplary embodiment, the device hole does not need the wiring substrate 20 which surrounds the liquid discharge substrate 10 to enclose the spreading flow of the sealing agent 50. Thus, the sizes of the wiring substrate 20 and the liquid discharge head 1 can be prevented from increasing. Similarly, no walls for enclosing the sealing agent 50 need to be provided around the electric connection portion using a highly viscous resin composition or the like. Thus, a manufacturing cost of the sealing agent 50 can be prevented from increasing. In other words, in one or more embodiments of the present disclosure, the size of the liquid discharge head can be prevented from increasing while preventing the sealing agent from spreading beyond the electric connection portion, so that the sealing of the electric connection portion can be guaranteed using the sealing agent.

It is to be noted reducing the amount of first sealing agent 50 for preventing the first sealing agent 50 from spreading beyond the electric connection portion is not an effective solution, because the lower side of the wires 40 may not be sufficiently protected. Thus, as described above, the first sealing agent 50 of an amount that is large enough to reach at least the intersecting points 17 is preferably applied.

Further, a sealing agent with a viscosity lower than the first sealing agent 50 may not stop spreading after reaching the intersecting points 17, to further spread over the third edges 32 contacting the back surface 18 of the liquid discharge substrate 10. Even such a first sealing agent 50 can be stopped and stay at a portion of the third edges 32 to be prevented from spreading over the third edges 32 for the following reason. More specifically, in the present exemplary embodiment, the first sealing agent 50 is applied with the surface 13 of the liquid discharge substrate 10 facing upward in the direction of gravity. Thus, there is no supporting surface for the first sealing agent 50 that has reached the third edges 32, on the lower side of the agent 50 in the direction of gravity. Thus, downward force in the direction of the lower direction acts against the first sealing agent 50 that will otherwise spread over the third edges 32, which stops the flow of the first sealing agent 50 along the third edges 32. Thus, the first sealing agent 50 is prevented from spreading over the third edges 32 of the first sealing agent 50 and stopped, and thus does not spread beyond the portion of the third edges 32. In such a case, the first sealing agent 50 continuously spreads from the space on the lower side of the wires 40 over the portion of the second edge 16 and beyond the intersecting points 17 to reach the portion of the third edges 32 that is in contact with the back surface 18 of the liquid discharge substrate 10.

In the present exemplary embodiment, the end portions of the liquid discharge substrate 10 on the sides of the second side surfaces 15 protrude beyond the surface 31 of the support substrate 30. Thus, the third edges 32 over which the first sealing agent 50 may spread are positioned on the back surface side of the liquid discharge substrate 10. Accordingly, even when the first sealing agent 50 has spread beyond the intersecting points 17, the agent 50 spreads over the third edges 32. Thus, the first sealing agent 50 can be prevented from attaching to the surface 13 side of the liquid discharge substrate 10 provided with the discharge ports 2 or to the surface side of the wiring substrate 20.

The first sealing agent 50 is applied to the space on the lower side of the wires 40. After the spreading over the intersecting points 17 or over the third edges 32 is stopped as described above, a second sealing agent 51 is applied to the upper side of the wires 40. As a result, the upper side of the wires 40 is covered with the second sealing agent 51 as illustrated in FIG. 2, which is a cross-sectional view taken along line A-A in FIG. 1B illustrating a state where the second sealing agent 51 is applied.

The second sealing agent 51 is applied to cover the upper side of the wires 40 to perform insulation for protection, and may be liquid epoxy resin, acrylic resin, epoxy acrylate resin, imide resin, amide resin, or the like, as in the case of the first sealing agent 50. It is desirable that the second sealing agent 51 has a viscosity in a range between 100 and 800 Pa·s, preferably in a range between 100 and 400 Pa·s so that it stays on the upper side of the wires 40.

The first sealing agent 50 and the second sealing agent 51 applied to the lower and the upper sides of the wires 40 are cured. Thus, the electric connection portion including the wires 40 can be protected by the sealing agents.

An angle between the second edge 16 and the third edges 32 on the side of a surface on which the liquid discharge substrate 10 and the support substrate 30 are joined is preferably from 0° to not larger than 135°, which effectively prevents the first sealing agent 50 from spreading beyond the electric connection portion.

In the present exemplary embodiment, the liquid discharge substrate 10 has the two end portions on the sides of the second side surfaces 15 protruding beyond the support substrate 30. Thus, as illustrated in FIG. 3A, the second edge 16 forming the first side surface 14 intersects with each of the two third edges 32 forming the surface 31 of the support substrate 30 to form the two intersecting points 17 described above. In such a case, the sealing agent of an amount sufficient to reach at least one of the two intersecting points 17 has only to be applied.

Figure 5A:
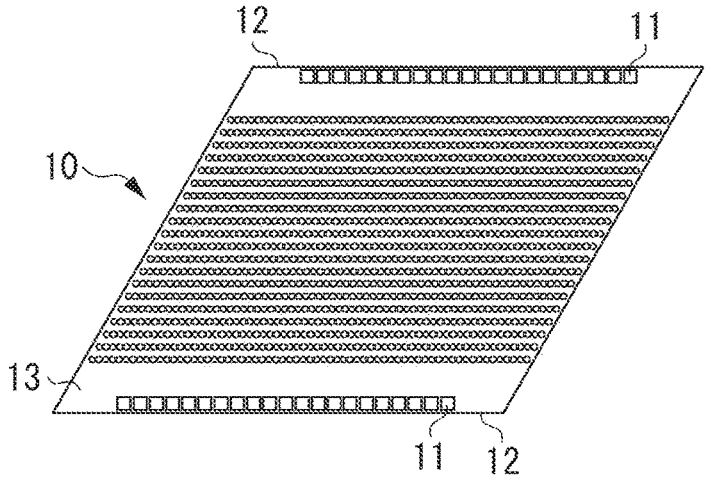
FIGS. 5A, 5B, and 5C are each a diagram illustrating another configuration of a liquid discharge head.
Figure 5B:
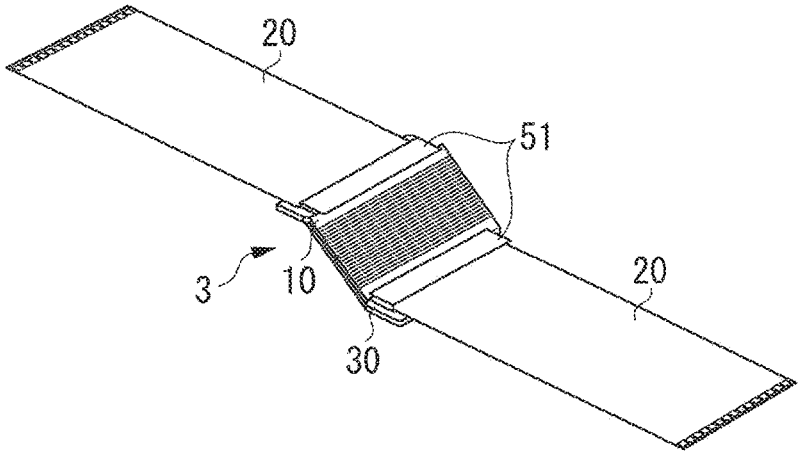
Figure 5C:
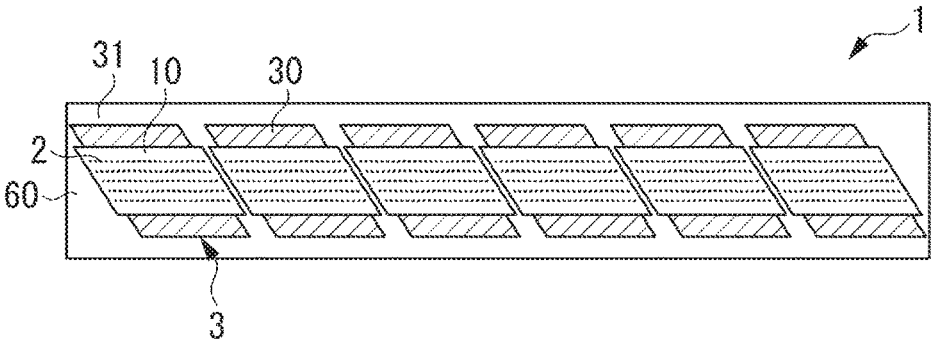

FIGS. 5A to 5C are diagrams illustrating other modes of the liquid discharge head 1. FIG. 5A is an upper view of the liquid discharge substrate 10. FIG. 5B is a perspective view of the liquid discharge unit 3. FIG. 5C is an upper view of the liquid discharge head 1 of a line type with a plurality of liquid discharge units 3 arranged in the arrayed direction of the discharge ports 2. In FIG. 5C, the wiring substrate 20 and the sealing agents are omitted.

As illustrated in FIG. 5A, a pad 11 of the liquid discharge substrate 10 may also be provided opposite to one first edge 12 of the surface 13 near the other first edge on the liquid discharge substrate 10. In this configuration, two wiring substrates 20 are connected to two areas where the pads 11 of a single liquid discharge substrate 10 are provided as illustrated in FIG. 5B. Also in such a liquid discharge head 1, the first sealing agent can be prevented from spreading without providing surround walls in such a way that the liquid discharge substrate 10 and the support substrate 30 are configured on the side of the other first edge 12 as described above.

The liquid discharge substrate 10 is not limited to a rectangular parallelepiped of plate shape, and the surface 13 may have a parallelogram shape as illustrated in FIG. 5A. The support substrate 30 is also not limited to a rectangular parallelepiped of a plate shape, and the surface 31 may have a parallelogram shape as illustrated in FIG. 5C. As illustrated in FIG. 5C, the liquid discharge head 1 of the line type may be formed with the plurality of liquid discharge units 3 arranged on the support substrate 60, which include the liquid discharge substrate 10, the wiring substrate 20, and the support substrate 30.

Figure 6:
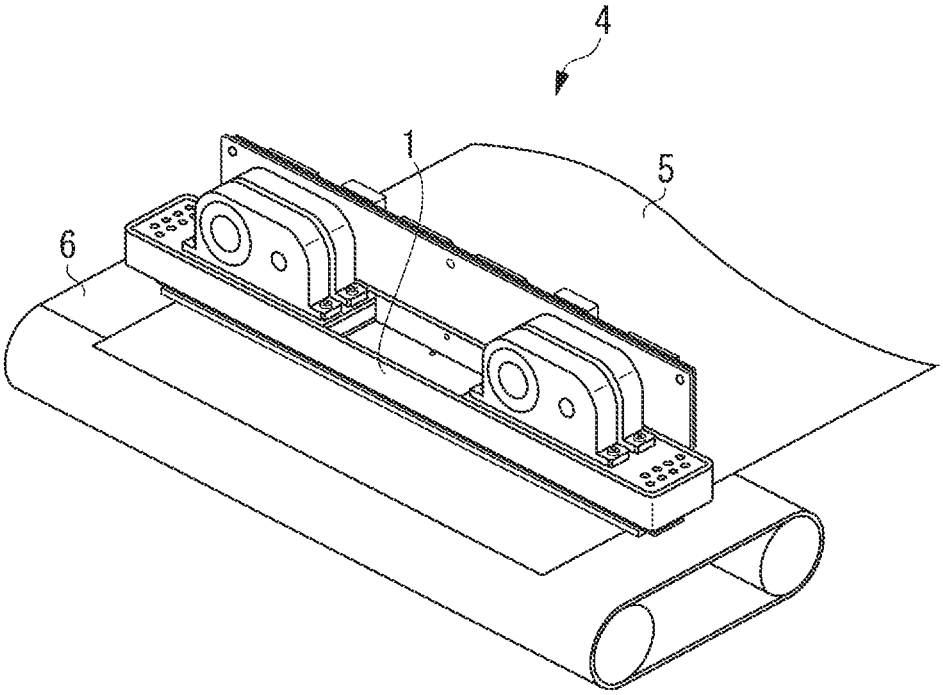
FIG. 6 is a diagram illustrating a liquid discharge device.

FIG. 6 is a diagram illustrating a schematic configuration of a liquid discharge device on which the liquid discharge head 1 is mounted. The liquid discharge device illustrated in FIG. 6 is an inkjet recording device 4 on which an inkjet head is mounted. The inkjet head is configured to discharge liquid ink to perform recording on a recording medium. The inkjet recording device 4 is provided with a conveyance unit 6 that conveys a recording medium 5 and with the liquid discharge head 1 that is arranged substantially orthogonal to a conveyance direction of the recording medium 5.

A first example is described below. In the present example, the liquid discharge substrate 10, the wiring substrate 20, and the support substrate as illustrated in FIG. 3A were prepared. The pads 11 on the liquid discharge substrate 10 and the pads 21 on the wiring substrate 20 were connected using the wires 40 made of gold with a wire diameter of 25 μm, and arranged with a pitch of 100 μm between adjacent wires 40.

The first sealing agent 50 was applied through the gap between the adjacent wires 40, from above the wires 40. An epoxy resin composition which is thermosetting curable amine with a viscosity of 40 Pa·s was used for the first sealing agent 50. The first sealing agent 50 having a low viscosity spread along the second edge 16 beyond the space on the lower side of the wires 40. Then, the first sealing agent 50 reached the intersecting points 17 between the second edge 16 and the third edges 32. The first sealing agent 50 stopped spreading in the state illustrated in FIG. 4A.

Then, the second sealing agent 51 was applied to the upper side of the wires 40. An epoxy resin composition which is thermosetting curable amine with a viscosity of 300 Pa·s was used for the second sealing agent 51. The second sealing agent 51 having a high viscosity stayed on the upper side of the wires 40 as illustrated in FIG. 2. Then, the first sealing agent 50 and the second sealing agent 51 were thermally treated to be cured. As a result, the liquid discharge head was obtained in which the electric connection portion including the wires 40 is covered with the sealing agents to be insulated for protection.

A second example is described below. In this example, the connection between the pads 11 on the liquid discharge substrate 10 and the pads 21 on the wiring substrate 20 was performed using the wires 40 as in the first example.

Figure 4B:
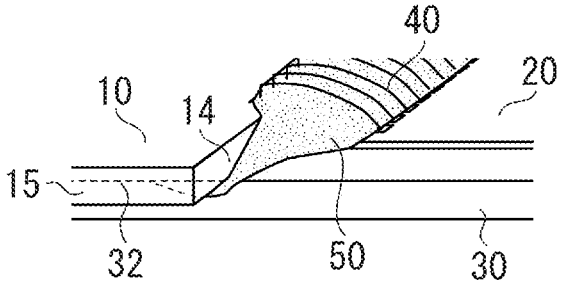

Then, the first sealing agent 50 was applied through the gap between the adjacent wires 40, from above the wires 40. In this example, an epoxy resin composition which is a thermosetting curable acid anhydride type with a viscosity of 5 Pa·s was used for the first sealing agent 50. The first sealing agent 50 spread beyond the space on the lower side of the wires 40 along the second edge 16. The spreading was hindered when the first sealing agent 50 reached the intersecting points 17. However, the first sealing agent 50 used in this example had a lower viscosity than that in the first example. Thus, the spreading force due to the capillary phenomenon was high, and the first sealing agent 50 did not stop spreading at the intersecting points 17. The first sealing agent 50 passed through the intersecting points 17 to further spread onto the third edges 32 (FIG. 4B). The support substrate 30 was not present on the lower side in the direction of gravity of the first sealing agent 50 spreading on the third edges 32. Therefore, the first sealing agent 50 was prevented from spreading over the third edges 32 due to the capillary phenomenon. Thus, the first sealing agent 50 stopped spreading and stayed after spreading onto the portion of the third edges 32.

Then, as in the first example, the second sealing agent 51 was applied to the upper side of the wires 40. An epoxy resin composition which is a thermosetting curable acid anhydride type with a viscosity of 250 Pa·s was used for the second sealing agent 51. Then, the first sealing agent 50 and the second sealing agent 51 were thermally treated and cured to obtain a liquid discharge head.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-098242, filed May 16, 2016, which is hereby incorporated by reference herein in its entirety.

What is claimed is:

1. A liquid discharge head comprising:

a liquid discharge substrate configured to discharge liquid, the liquid discharge substrate including: a surface on which at least one pad is disposed close to a first edge; a first side surface that is adjacent to the surface with the first edge in between; at least one second side surface that is adjacent to the surface and the first side surface; and a back surface that is adjacent to the first side surface with a second edge in between opposing the first edge;

a wiring substrate including at least one wiring;

a support substrate that is in contact with the second edge and includes a surface on which the back surface of the liquid discharge substrate is joined; and a sealing agent provided in a space defined by the surface of the support substrate, the first side surface, and an electric connection portion in which the at least one pad and the at least one wiring are electrically connected to each other, the electric connection portion extending in a direction crossing the first edge as viewed from the surface of the liquid discharge substrate, wherein the second edge and at least one third edge intersect at an intersecting point, the at least one third edge forming the surface of the support substrate and being in contact with the back surface of the liquid discharge substrate, wherein the sealing agent is provided on the second edge from the space to the intersecting point, and wherein the liquid discharge substrate has an end portion on a side of the at least one second side surface, which protrudes beyond an end portion of the surface of the support substrate, as viewed from the surface of the liquid discharge substrate.

2. The liquid discharge head according to claim 1, wherein the sealing agent is provided on a portion of the third edge that is in contact with the back surface of the liquid discharge substrate.

3. The liquid discharge head according to claim 1, wherein an angle between the second edge and the third edge on a side of a surface on which the liquid discharge substrate and the support substrate are joined, is not larger than 135°.

4. The liquid discharge head according to claim 1, wherein the at least one second side surface of the liquid discharge substrate includes two second side surfaces, wherein the at least one third edge of the support substrate includes two third edges, wherein the liquid discharge substrate has end portions on sides of the two second side surfaces, which protrude beyond the end portion of the surface of the support substrate, as viewed from the surface of the liquid discharge substrate, and wherein the sealing agent is disposed on the intersecting point between the second edge and at least one of the two third edges of the support substrate.

5. The liquid discharge head according to claim 1, wherein the wiring substrate includes: a surface on which a pad connected to the at least one pad of the liquid discharge substrate is disposed; and a back surface joined to the surface of the support substrate, and wherein a distance between the surface of the support substrate and the pad of the wiring substrate in an orthogonal direction orthogonal to the surface of the support substrate is shorter than a distance between the surface of the support substrate and the at least one pad of the liquid discharge substrate in the orthogonal direction.

6. The liquid discharge head according to claim 1, wherein the at least one pad includes a plurality of the pads arranged on the surface of the liquid discharge substrate along the first edge and the at least one wiring includes a plurality of wirings.

7. The liquid discharge head according to claim 1 comprising:

a plurality of the liquid discharge substrates;

a plurality of the wiring substrates each connected to the liquid discharge substrates; and a plurality of the support substrates each joined to the liquid discharge substrates.

8. The liquid discharge head according to claim 7, further comprising:

another support substrate supporting the plurality of the support substrates, wherein the liquid discharge head is a line type head.

9. The liquid discharge head according to claim 8, wherein a direction along the at least one second side surface and an array direction of the plurality of the liquid discharge substrates intersect obliquely, as viewed from the surface of the liquid discharge substrate.

10. A liquid discharge device on which the liquid discharge head according to claim 1 is mounted.

11. The liquid discharge head according to claim 1, wherein the electric connection portion includes at least one wire connecting the at least one pad of the liquid discharge substrate and at least one pad of the wiring substrate.

12. The liquid discharge head according to claim 1, wherein at least one pad is disposed on the surface of the liquid discharge substrate close to an edge opposing the first edge, wherein a wiring substrate different from the wiring substrate is electrically connected to the at least one pad disposed close to the opposing edge.

13. A method for manufacturing a liquid discharge head that includes a liquid discharge substrate configured to discharge liquid, the liquid discharge substrate including: a surface on which at least one pad is disposed close to a first edge; a first side surface that is adjacent to the surface with the first edge in between; at least one second side surface that is adjacent to the surface and the first side surface; and a back surface that is adjacent to the first side surface with a second edge in between opposing the first edge, a wiring substrate including at least one wiring, and a support substrate that is in contact with the second edge and includes a surface on which the back surface of the liquid discharge substrate is joined, the method comprising:

joining the liquid discharge substrate and the support substrate to each other in such a manner that the second edge and at least one third edge intersect at an intersecting point and that the liquid discharge substrate has an end portion on a side of the at least one second side surface, protruding beyond an end portion of the surface of the support substrate, as viewed from the surface of the liquid discharge substrate, the at least one third edge forming the surface of the support substrate and being in contact with the back surface of the liquid discharge substrate; and applying a sealing agent to a space defined by the surface of the support substrate, the first side surface, and an electric connection portion in which the at least one pad and the at least one wiring are electrically connected to each other, the electric connection portion extending in a direction crossing the first edge as viewed from the surface of the liquid discharge substrate, wherein the sealing agent flows over a portion of the second edge toward the at least one second side surface from the space, to reach at least the intersecting point.

14. The method for manufacturing a liquid discharge head according to claim 13, wherein the sealing agent is applied, with the surface of the liquid discharge substrate facing upward in or along a direction of gravity.

15. The method for manufacturing a liquid discharge head according to claim 14, wherein the sealing agent flows over the intersecting point to reach a portion of the at least one third edge that is in contact with the back surface of the liquid discharge substrate.

16. The method for manufacturing a liquid discharge head according to claim 13, wherein an angle between the second edge and the at least one third edge on a side of the surface on which the liquid discharge substrate and the support substrate are joined, is not larger than 135°.

17. The method for manufacturing a liquid discharge head according to claim 13, wherein the at least one second side surface of the liquid discharge substrate includes two second side surfaces, wherein the at least one third edge of the support substrate includes two third edges, wherein the liquid discharge substrate has end portions on sides of the two second side surfaces, which protrude beyond the end portion of the surface of the support substrate, as viewed from the surface of the liquid discharge substrate, and wherein the sealing agent is disposed on the intersecting point between the second edge and at least one of the two third edges of the support substrate.

18. A method for manufacturing a liquid discharge head that includes a liquid discharge substrate configured to discharge liquid, the liquid discharge substrate including: a surface on which at least one pad is disposed close to a first edge; a first side surface that is adjacent to the surface with the first edge in between; at least one second side surface that is adjacent to the surface and the first side surface; and a back surface that is adjacent to the first side surface with a second edge in between opposing the first edge, a wiring substrate including at least one wiring, and a support substrate that is in contact with the second edge and includes a surface on which the back surface of the liquid discharge substrate is joined, the method comprising:

joining the liquid discharge substrate and the support substrate to each other in such a manner that the second edge and at least one third edge intersect at an intersecting point and that the liquid discharge substrate has an end portion on a side of the at least one second side surface, protruding beyond an end portion of the surface of the support substrate, as viewed from the surface of the liquid discharge substrate, the at least one third edge forming the surface of the support substrate and being in contact with the back surface of the liquid discharge substrate; and applying a sealing agent to a space defined by the surface of the support substrate, the first side surface, and an electric connection portion in which the at least one pad and the at least one wiring are electrically connected to each other, the electric connection portion extending in a direction crossing the first edge as viewed from the surface of the liquid discharge substrate, wherein the sealing agent flows over a portion of the second edge toward the at least one second side surface from the space.

19. The method for manufacturing a liquid discharge head according to claim 18, wherein the sealing agent is applied, with the surface of the liquid discharge substrate facing upward in a direction of gravity.

20. The method for manufacturing a liquid discharge head according to claim 18, wherein the at least one second side surface of the liquid discharge substrate includes two second side surfaces, wherein the at least one third edge of the support substrate includes two third edges, wherein the liquid discharge substrate has end portions on sides of the two second side surfaces, which protrude beyond the end portion of the surface of the support substrate, as viewed from the surface of the liquid discharge substrate, and wherein the sealing agent is disposed on the intersecting point between the second edge and at least one of the two third edges of the support substrate.

* * * * *